US008294746B2

(12) United States Patent
Naruse

(10) Patent No.: US 8,294,746 B2
(45) Date of Patent: Oct. 23, 2012

(54) IMAGE FORMING APPARATUS WITH EXPOSING UNIT AND PHOTOSENSITIVE MEMBER

(75) Inventor: Kenichi Naruse, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 143 days.

(21) Appl. No.: 12/724,212

(22) Filed: Mar. 15, 2010

(65) Prior Publication Data

US 2010/0238259 A1 Sep. 23, 2010

(30) Foreign Application Priority Data

Mar. 17, 2009 (JP) ..... 2009-064302

(51) Int. Cl.
*B41J 2/435* (2006.01)

(52) U.S. Cl. ..... 347/245; 347/263

(58) Field of Classification Search ..... 347/238, 347/241, 242, 245, 256, 257, 263
See application file for complete search history.

(56) References Cited

U.S. PATENT DOCUMENTS

| | | | | |
|---|---|---|---|---|
| 4,905,028 | A * | 2/1990 | Okubo et al. | 347/138 |
| 5,561,499 | A | 10/1996 | Setoriyama | |
| 5,808,649 | A | 9/1998 | Shimanari et al. | |
| 6,252,619 | B1 | 6/2001 | Ueda et al. | |
| 7,656,421 | B2 * | 2/2010 | Itabashi | 347/138 |
| 7,825,946 | B2 * | 11/2010 | Sugiyama et al. | 347/242 |
| 7,982,761 | B2 * | 7/2011 | Yokoi | 347/242 |
| 2008/0145109 | A1 * | 6/2008 | Murayama et al. | 399/260 |
| 2008/0292359 | A1 | 11/2008 | Yamaguchi | |

FOREIGN PATENT DOCUMENTS

| | | | |
|---|---|---|---|
| JP | H02-010548 | U | 1/1990 |
| JP | H02-273258 | A | 11/1990 |
| JP | H04-116666 | A | 4/1992 |
| JP | H05-008566 | U | 2/1993 |
| JP | H05-216305 | A | 8/1993 |
| JP | H05-323697 | A | 12/1993 |
| JP | H07-026852 | U | 5/1995 |
| JP | H09-160333 | A | 6/1997 |
| JP | 2000-181165 | A | 6/2000 |
| JP | 2001-158123 | A | 6/2001 |
| JP | 2001-312157 | A | 11/2001 |
| JP | 2002-287455 | A | 10/2002 |
| JP | 2006-035597 | A | 2/2006 |
| JP | 2008-275819 | A | 11/2008 |

OTHER PUBLICATIONS

Japan Patent Office; Notification of Reasons for Refusal for Patent Application No. 2009-064302, dated Jan. 25, 2011.

* cited by examiner

*Primary Examiner* — Hai C Pham
(74) *Attorney, Agent, or Firm* — Baker Botts L.L.P.

(57) ABSTRACT

An image forming apparatus includes: a photosensitive member, a housing, a cover, an exposing unit fit to the cover and which moves closer toward/away from the photosensitive member in response to opening/closing of the cover, wherein the exposing unit forms a latent image on the photosensitive member by exposing the photosensitive member when the exposing unit is arranged in close vicinity to the photosensitive member by the closing of the cover, an image forming unit, which forms an image corresponding to the latent image and a housing side electrode provided inside of the housing, wherein the housing side electrode feeds an exposing power to an exposing unit side electrode by contacting the exposing unit side electrode provided in the exposing unit when the exposing unit is arranged in close vicinity to the photosensitive member by the closing of the cover.

7 Claims, 10 Drawing Sheets

IMAGE FORMING APPARATUS WITH EXPOSING UNIT AND PHOTOSENSITIVE MEMBER

CROSS-REFERENCE TO RELATED APPLICATIONS

This application claims priority from Japanese Patent Application No. 2009-064302 filed on Mar. 17, 2009, the entire subject matter of which is incorporated herein by reference.

TECHNICAL FIELD

The present invention relates to an image forming apparatus for forming an image on a recording medium and, more specifically, an image forming apparatus for forming the image by causing an exposing unit, which is fitted to a cover that is provided retractably to a housing, to expose a photosensitive member housed in the housing.

BACKGROUND

In recent years, there has been proposed a known image forming apparatus for forming an image by exposing a photosensitive member with an exposing unit comprising an LED, etc. The known image forming apparatus includes: a photosensitive member on which a latent image is formed by an exposure; a housing for housing the photosensitive member in internally; a cover provided retractably to the housing; an exposing unit included to the cover to move close to/away from the photosensitive member in response to the opening/closing of the cover to expose the photosensitive member when the cover is closed and the exposing unit is positioned close to the photosensitive member; and an image forming unit for forming an image, which corresponds to a latent image formed on the photosensitive member by the exposure, on a recording medium.

In the known image forming apparatus, the exposing unit is positioned close to the photosensitive member by closing the cover such that the exposing unit exposes the photosensitive member. The image is corresponding to the latent image formed on the photosensitive member by the exposure. The image is formed on the recording medium via the image forming unit. Also, there has been proposed a known method of connecting the control board of the image forming apparatus to the LEDs with the cable for feeding electric power to the LEDs

SUMMARY

Illustrative aspects of the present invention provide an image forming apparatus that enables to feed a power to an exposing unit without requiring a long power feeding cables.

BRIEF DESCRIPTION OF THE DRAWINGS

Illustrative aspects of the invention will be described in detail with reference to the following figures wherein.

DETAILED DESCRIPTION

<General Overview>

Figure 1:
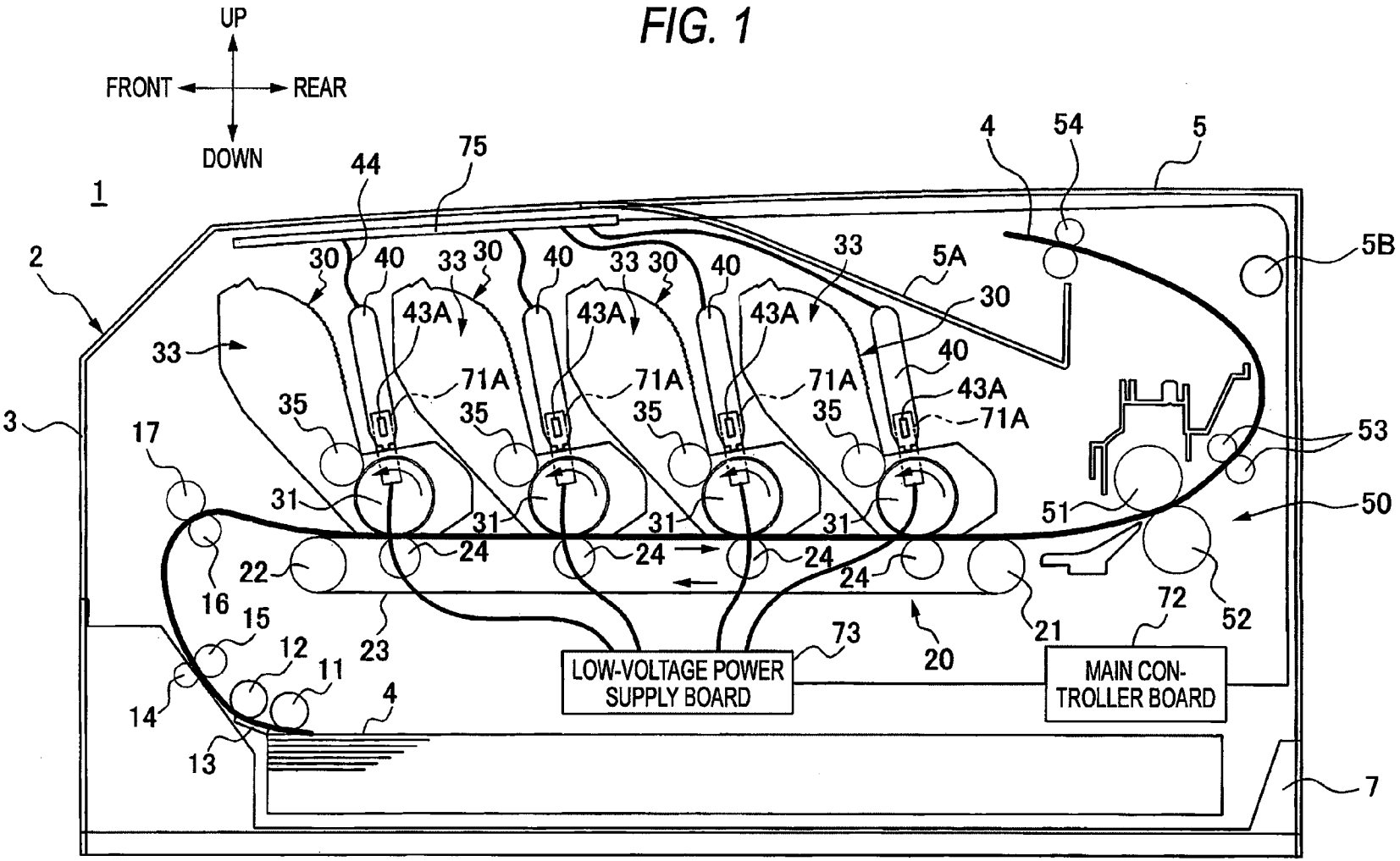
FIG. 1 is a longitudinal sectional view showing a schematic configuration of an image forming apparatus to which an exemplary embodiment of the present invention is applied.

However, in the related image forming apparatus, a cable, which feed an electric power used for the exposure, is extending from power source in the housing to the exposing unit on the cover through the hinge connecting the cover and the housing. Thus, the cable is required to be long enough for detour the hinge. The long cable causes voltage drops, and the voltage drops causes various problems such as brightness of LEDs being lowered, etc. In order to minimize the voltage drops by the cable, the cable formed by a thick electric wire or a number of electric wires are required. In view of above, exemplary embodiments of the present invention have been made to attain a power feeding to the exposing unit without the long cable.

According to a first aspect of an exemplary embodiment of the invention, there is provided an image forming apparatus comprising: a photosensitive member; a housing that houses the photosensitive member; a cover that is retractably attached to the housing; an exposing unit, which is included to the cover, which moves closer to/away from the photosensitive member in response to an opening/closing of the cover, and which forms a latent image on the photosensitive member by exposing the photosensitive member when the exposing unit is arranged in close vicinity to the photosensitive member by the closing of the cover; an image forming unit that forms an image on a recording medium, the image corresponding to the latent image formed on the photosensitive member by the exposure; and a housing side electrode, which is included inside the housing, and which feeds an exposing power to an exposing unit side electrode by contacting the exposing unit side electrode included in the exposing unit, when the exposing unit is arranged in close vicinity to the photosensitive member by the closing of the cover.

According to an exemplary embodiment of the present invention, when the cover is closed and the exposing unit is thus arranged in close vicinity to the photosensitive member, the housing side electrodes included inside the housing come into contact with the exposing unit side electrodes provided in the exposing unit and feed an exposing power to the exposing unit side electrodes. Therefore, there is no need for long power feeding cables, which pass through the hinges that swingably fix the cover to the housing, and the like. The exposing power can be stably fed at a low cost. Also, when the cover is opened, the exposing unit side electrodes are moved away from the housing side electrodes and thus the exposure is stopped. Thus, a situation in which the light emitted from the exposing unit exerts an influence on the human body, etc., can also be prevented.

Further, according to a second aspect of consistent with an exemplary embodiment of the invention, the exposing unit includes a head, in which a plurality of light emitting elements are provided integrally therewith along a scanning direction of the photosensitive member, and the exposing unit side electrode is provided to an outer periphery of the head. According thereto, the power can be fed directly to the head in which a plurality of light emitting elements are integrally provided, and the loss of power etc. can be lessened more satisfactorily.

According to a third aspect an exemplary embodiment of the invention, the image forming apparatus may also comprise a potential detecting unit that detects a potential of the exposing unit side electrode; and an open/close determining unit that determines whether the cover is open or closed based on whether or not a potential detected by the potential detecting unit is within a predetermined range corresponding to a potential that is given when the housing side electrode contacts the exposing unit side electrode.

When such a potential detecting unit is provided, the potential of the exposing unit side electrode, the potential detected by the detecting unit, changes in response to whether or not the exposing unit side electrode contacts the housing side electrode. Therefore, the open/close determining unit determines whether the cover is open or closed based on whether or not the potential detected by the potential detecting unit is within a predetermined range corresponding to a potential that is given when the housing side electrode contacts the exposing unit side electrode. As a result, even though a switch for detecting whether the cover is open or closed is not separately provided, the open/close of the cover can be decided satisfactorily.

According to a fourth aspect of an exemplary embodiment of the invention, the open/close determining unit determines that the cover is closed when the potential detected by the potential detecting unit is in excess of a first threshold value corresponding to a potential that is given when the housing side electrode contacts the exposing unit side electrode, the open/close determining unit determines that the cover is opened when the potential that the potential detecting unit detects is below a second threshold value corresponding to a potential that is given when the housing side electrode does not contact the exposing unit side electrode, and the open/close determining unit determines that contact between the housing side electrode and the exposing unit side electrode is bad when the potential that the potential detecting unit detects is a value located between the first threshold value and the second threshold value.

According thereto, by comparing the potential detected by the potential detecting unit with the first threshold value and the second threshold value, it is possible to decide three types of states, i.e., whether or not the cover is closed, whether or not the cover is opened, and whether or not the contact between the housing side electrode and the exposing unit side electrode is bad.

In addition, according to a fifth aspect of an exemplary embodiment of the invention, the exposing unit side electrode is included at both ends of the head in a scanning direction of the photosensitive member, the potential detecting unit detects a potential of the exposing unit side electrode at both ends of the head respectively, the open/close determining unit determines that the cover is opened when both potentials detected by the potential detecting unit at both ends are not within the predetermined range, the open/close determining unit determines that one end of the cover is floating in the scanning direction of the photosensitive member when one of the potentials detected by the potential detecting unit at both ends of the head is not within the predetermined range but the other potential detected by the potential detecting unit is within the predetermined range, and the open/close determining unit determines that the cover is closed when both potentials detected by the potential detecting unit at both ends of the head are within the predetermined range.

That is, when the exposing unit side electrode is provided to both ends of the head in the scanning direction of the photosensitive member, it is possible to decide whether or not the cover is opened, whether only one end of the cover is floating in the scanning direction of the photosensitive member, or whether the cover is closed, based on whether potentials of the exposing unit side electrode measured at both ends are not within the predetermined range, only one potential is within the predetermined range, or potentials measured at both ends are within the predetermined range. Therefore, when the potential detecting unit detects the potential of the exposing unit side electrode at both ends respectively and also the open/close determining unit determines as described above, it is possible to decide whether or not the cover is opened, whether or not only one end of the cover is floating in the scanning direction of the photosensitive member, or whether or not the cover is closed.

In addition, even when the contact between the housing side electrode and the exposing unit side electrode is bad, or even when one side of the top cover is floating, in many cases the user perceives that the cover is perfectly closed. Thus, when the open/close determining unit can determine the contact between the housing side electrode and the exposing unit side electrode is bad or not perfect, advantages can be achieved by issuing an alarm, and the like.

According to a sixth aspect of an exemplary embodiment of the invention, the image forming apparatus further comprises a display unit that displays a message if the open/close determining unit determines that the cover is open.

According to a seventh aspect of an exemplary embodiment of the invention, the image forming apparatus further comprises a notification unit that notifies a user to close the cover if the open/close determining unit determines that the cover is open.

<Exemplary Embodiments>

Exemplary embodiments of the invention will now be described with reference to the drawings. In FIG. 1, which is a longitudinal sectional view showing a schematic configuration of an image forming apparatus according to an exemplary embodiment of the present invention, only LED units 40 (which will be described later) are depicted as a side view. Also, in the following explanation, the left side in FIG. 1 is assumed as the front side of the image forming apparatus and the nearest side in FIG. 1 is assumed as the right side of the image forming apparatus.

(Overall Configuration of Image Forming Apparatus)

An image forming apparatus 1, which is a direct transfer tandem system color printer, has a substantially box-shaped housing 2, as shown in FIG. 1. A front cover 3 is provided on the front of the housing 2. A sheet discharge tray 5A is formed on an upper surface of the housing 2. Sheets 4 (example of a recording medium) after the image formation are piled up on the sheet discharge tray 5A. As an example of a cover on which the sheet discharge tray 5A is provided integrally and which covers the upper area of the image forming apparatus 1, a top cover 5 is provided retractably on the rear top end of the image forming apparatus 1 (see FIG. 2). When this top cover 5 is opened, an image forming unit 30 and a belt unit 20 (which will be described later) can be pulled up from the inside of the housing 2.

A sheet feed tray 7 in which the sheets 4 to form the image are contained is installed into the bottom portion of the housing 2 such that such tray can be pulled open. A pressure plate (not shown) is provided in the sheet feed tray 7. The pressure plate supports the stacked sheets 4 tiltably to lift the front end of the sheets 4. A sheet feed roller 11 for carrying the sheet 4 is provided in a front upper end position of the sheet feed tray 7. A separate roller 12 and a separate pad 13 are provided on the downstream side in the sheet carrying direction of the sheet feed roller 11. The separate roller 12 and the separate pad 13 is separating the sheet 4 being carried by the sheet feed roller 11 sheet by sheet.

The uppermost sheet 4 in the sheet feed tray 7 is separated from the other sheets by the separation roller 12. The sheet 4 is sandwiched by a paper dust collect roller 14 and an opposing roller 15, and then fed to a space between registration rollers 16, 17. The registration rollers 16, 17 feed the sheet 4 onto the subsequent belt unit 20 at a predetermined timing.

The belt unit 20 is detachably attached to the housing 2. The belt unit 20 includes a carry belt 23 (so-called transfer carry belt) that is strung horizontally between a belt driving roller 21 and a tension roller 22. The belt driving roller 21 and the tension roller 22 are arranged at a distance longitudinally. The carry belt 23 is the endless belt formed of resin material such as polycarbonate, or the like. When the belt driving roller 21 located on the rear side is rotated/driven, the carry belt 23 is circulated/moved in the clockwise direction in FIG. 1 to carry backward the sheet 4 that is put on its upper surface.

(Configuration of Image Forming Portion)

Four transfer rollers 24 are aligned at a predetermined interval in the longitudinal direction on the inner side of the carry belt 23. The transfer rollers 24 are arranged opposite to respective photosensitive drums 31 (an example of the photosensitive members), and the transfer rollers 24 are provided on respective image forming units 30 described later. The carry belt 23 is put between respective photosensitive drums 31 and the corresponding transfer rollers 24. When the toner image (described later) is transferred, a transfer bias is applied between the transfer rollers 24 and the photosensitive drums 31, and a transfer current of predetermined magnitude is supplied.

Four image forming units 30 are paired with LED units 40 (an example of the exposing unit) and respectively correspond to respective colors of black, yellow, magenta, cyan from the front. The image forming units 30 and the LED units 40 are respectively arranged in series along the carrying direction of the sheet 4.

Each image forming unit 30 includes a photosensitive drum 31, a toner container 33, a develop roller 35, and the like. The photosensitive drum 31 has a drum main body that is formed by metal and is grounded, and is constructed by coating a surface layer of the drum main body with a positively chargeable photosensitive layer. A surface of the photosensitive drum 31 is positively charged by a charger during its rotation, and then is exposed by LEDs 41 (see FIG. 3), the LEDs (41) arranged in a row at the lower end of the LED unit 40 in the width direction of the sheet (the lateral direction, i.e., the scanning direction of the photosensitive drum 31). Thus, an electrostatic latent image is formed to correspond to the image that is to be formed on the sheet 4.

The positively chargeable nonmagnetic mono-component toner in each color of black, yellow, magenta, or cyan is respectively contained as the developer in the toner container 33. The toners contained in the toner container 33 are positively frictional-charged by the rotation of the develop roller 35, and the like. The toners are held on the develop roller 35 as a thin layer of predetermined thickness. Then, when the toners that are held on the develop roller 35 and charged positively come into opposing contact with the photosensitive drum 31 according to the rotation of the develop roller 35, such toners are fed to the electrostatic latent image that is formed on the surface of the photosensitive drum 31. Accordingly, the electrostatic latent image on the photosensitive drum 31 is visualized, and thus the toner image (an example of the developer image) is formed when the toners are attached only to the exposed area, the toner image is held on the surface of the photosensitive drum 31.

Then, while the sheet 4 is being carried by the carry belt 23 passes through the photosensitive drums 31 and the transfer rollers 24, the toner images being held on the surfaces of the photosensitive drums 31 are transferred sequentially onto the sheet 4 by the transfer current. Thus, the color image is formed on the sheet 4. The image forming unit 30 and the photosensitive drums 31 correspond to the image forming unit. Then, the sheet 4 on which the toner images of respective colors are superposed in this manner is carried to a fixing unit 50.

The fixing unit 50 is arranged at the back of the carry belt 23 in the housing 2.

The fixing unit 50 has a heating roller 51 and a pressure roller 52. The heating roller 51 has a heat source such as a halogen lamp and is rotated/driven. The pressure roller 52 is arranged opposite and below the heating roller 51 and is rotated to follow the heating roller 51 and pushes the heating roller 51. In this fixing unit 50, the toner images are fixed onto the sheet 4 by heating the sheet 4 on which the toner images in respective colors are transferred, while this sheet is sandwiched and carried between the heating roller 51 and the pressure roller 52. Then, the sheet 4 fixed the toner image is carried further by carry rollers 53 arranged in the position that is oblique to the upper rear of the fixing unit 50. Then, the sheet 4 is discharged onto the sheet discharge tray 5A by sheet discharge rollers 54, which are provided at the top portion of the housing 2.

Figure 2:
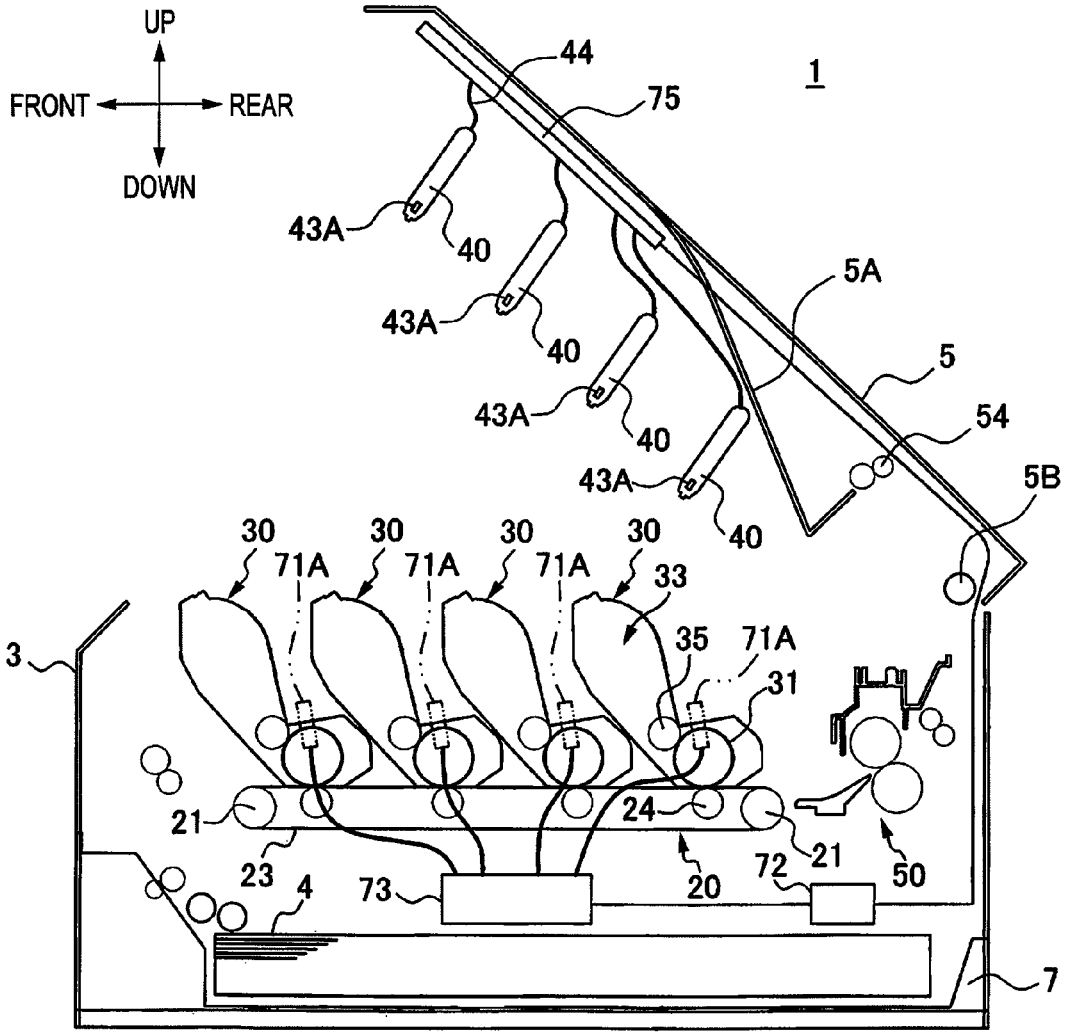
FIG. 2 is a longitudinal sectional view showing an operation of a top cover of the image forming apparatus.

As shown in FIG. 2, the top cover 5 is turned on a shaft 5B to open and close. the shaft 5B is provided to the rear end of the top cover in the lateral direction. Four LED units 40 are connected to a lower surface of the top cover 5. Therefore, as shown in FIG. 2, respective LED units 40 can be moved away from the photosensitive drums 31 by opening the top cover 5. As shown in FIG. 1, respective LED units 40 can be provided closely to the photosensitive drums 31 in their opposing positions respectively by closing the top cover 5. Because the LED units 40 are arranged closely to the photosensitive drums 31 in this manner, such LED units 40 can form the electrostatic latent image on the photosensitive drums 31 respectively, as described above.

(Configuration of LED Power Feeding Path)

Figure 3:
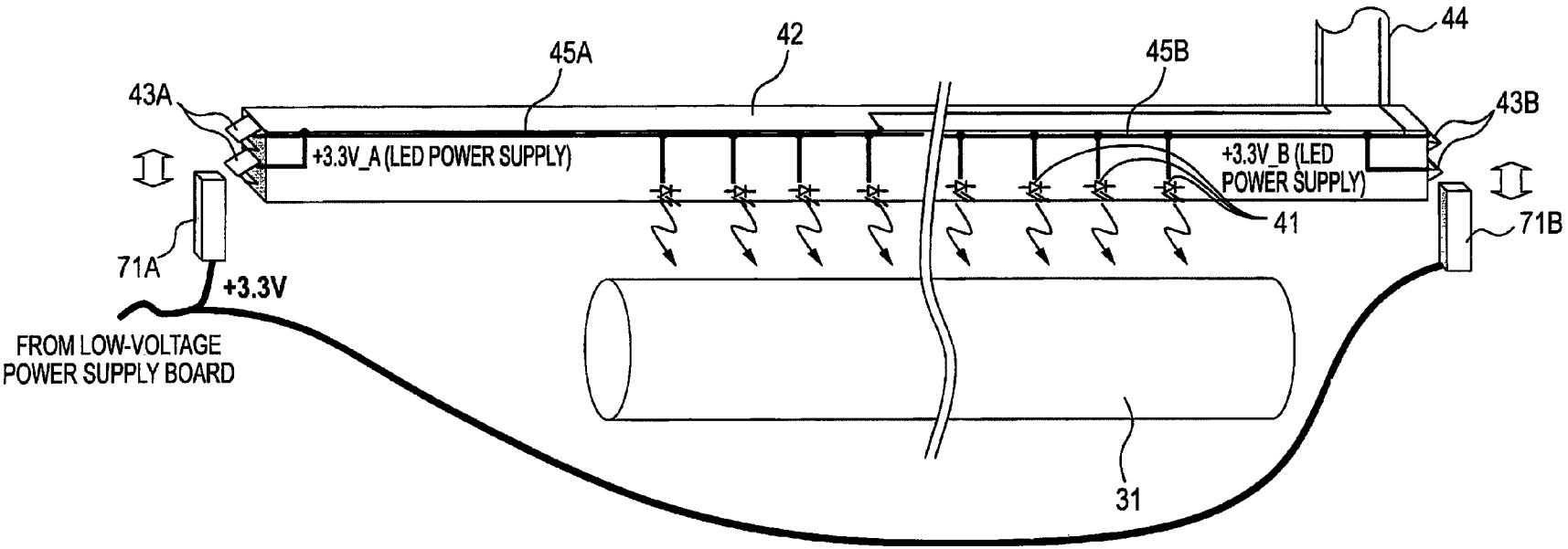
FIG. 3 is a perspective view showing a configuration around an LED head of the image forming apparatus.

Then, as shown in FIG. 3, an LED head 42 (an example of the head) is provided to the lower end of the LED unit 40. A plurality of LEDs 41 (an example of light emitting elements) are provided integrally on the LED head 42 in the lateral direction. The LED head 42 is constructed in a rectangular parallelepiped shape that is long in the lateral direction, and exposing unit side electrodes 43A, 43B (examples of electrodes on the exposing unit side) are provided at both ends in the lateral direction. The exposing unit side electrodes 43A, 43B are the well-known (such as those used in the charging stand for a battery, or the like). Each of the exposing unit side electrodes 43A, 43B has two ridge-like plate springs, which are shaped to protrude in the lateral direction and are arranged in the vertical direction (the direction in which the LED unit 40 is moved close to/away from the photosensitive drum 31). A control cable 44, which is composed of a flexible flat cable, is connected to one end of the top portion of the LED head 42 in the lateral direction.

As shown in FIG. 1 and FIG. 2, the exposing unit side electrodes 43A, 43B are exposed from the left and right side surfaces of the LED unit 40 respectively (only the right-side electrode 43A is illustrated in FIG. 1 and FIG. 2). Housing side electrodes 71A, 71B (examples of the housing side electrodes), which come into contact with the exposing unit side electrodes 43A, 43B respectively when the top cover 5 is closed, are provided in the housing 2 at both sides of the photosensitive drum 31 in the lateral direction. A drive voltage such as +3.3V is applied to the housing side electrodes 71A, 71B from a low-voltage power supply board 73. When the top cover 5 is closed and the exposing unit side electrodes 43A, 43B contact the housing side electrodes 71A, 71B respectively, the drive voltage for the lighting is applied to respective LEDs 41.

Figure 4:
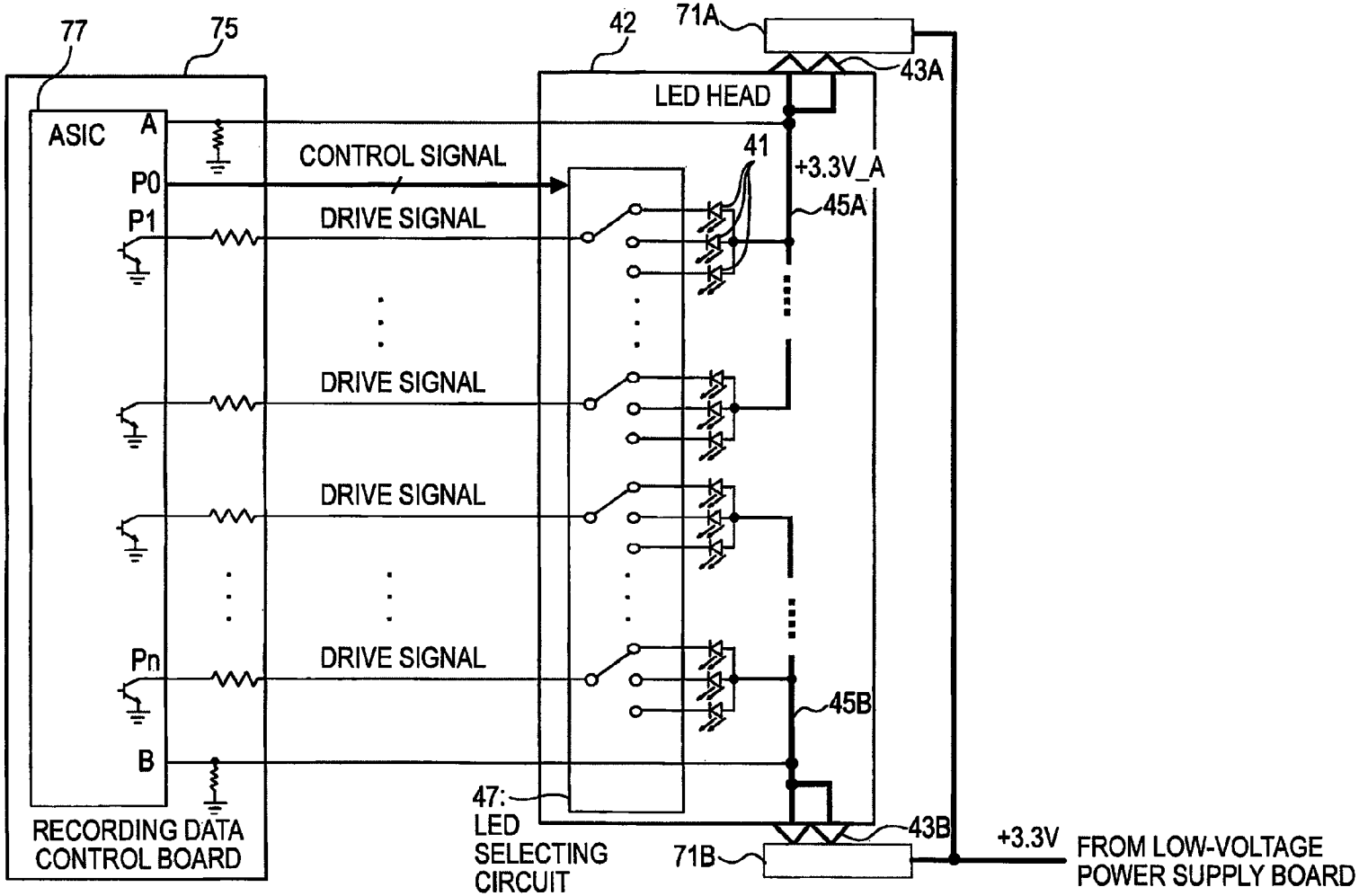
FIG. 4 is an explanatory view schematically showing power feeding cables to the LED head.

Then, a recording data control board 75 is provided to the lower surface of the top cover 5. The recording data control board 75 controls the lighting of respective LEDs 41 in response to recording data that is input from the external personal computer, or the like. The recording data is fed via a main controller board 72 in which ASIC, ROM, RAM, etc. (not shown) are built. The lighting control of respective LEDs 41 made by this recording data control board 75 will be explained hereunder. FIG. 4 is an explanatory view schematically showing power feeding cables to respective LEDs 41 built in the LED head 42. As shown in FIG. 4, the LEDs 41 are divided into two sets. The drive voltage applied to the exposing unit side electrode 43A is applied to the anodes of the LEDs 41 in one set of LEDs via an electric wire 45A. The drive voltage applied to the exposing unit side electrode 43B is applied to the anodes of the LEDs 41 in the other set of LEDs via an electric wire 45B. The LEDs 41, which are divided into two sets, are further divided into several groups. An LED selecting circuit 47 built in the LED head 42 switches which LEDs 41, which belong to respective groups, should be controlled by the recording data control board 75.

That is, the recording data control board 75 contains an ASIC 77. Ports P1 to Pn of the ASIC 77 cause cathodes of the LEDs 41 selected by the LED selecting circuit 47 to be grounded in response to the recording data. Then, electric current flows through the grounded LEDs 41 and the LEDs 41 are turned ON. A control signal is output from a port P0 of the ASIC 77. The control signal cause the LED selecting circuit 47 to change the selected states of the LEDs 41. Potentials of the electric wires 45A, 45B located in positions, which are closer to the exposing unit side electrodes 43A, 43B than branches to all LEDs 41, are input to analog input ports A, B (corresponding to a potential detecting unit) of the ASIC 77, which are respectively connected to A/D converters (not shown) built in the ASIC 77, respectively.

The ASIC 77 is connected to the main controller board 72 via signal wires that pass in vicinity of the shaft 5B. Also, although not shown, the ASIC 77 is connected to a main motor that drives the sheet feed roller 11, the photosensitive drums 31, etc., a display panel (an example of a display unit or a notification unit) provided at the top of the front cover 3, and the like via signal wires (not shown).

(Process of Detecting Cover Open/Close States)

Figure 5:
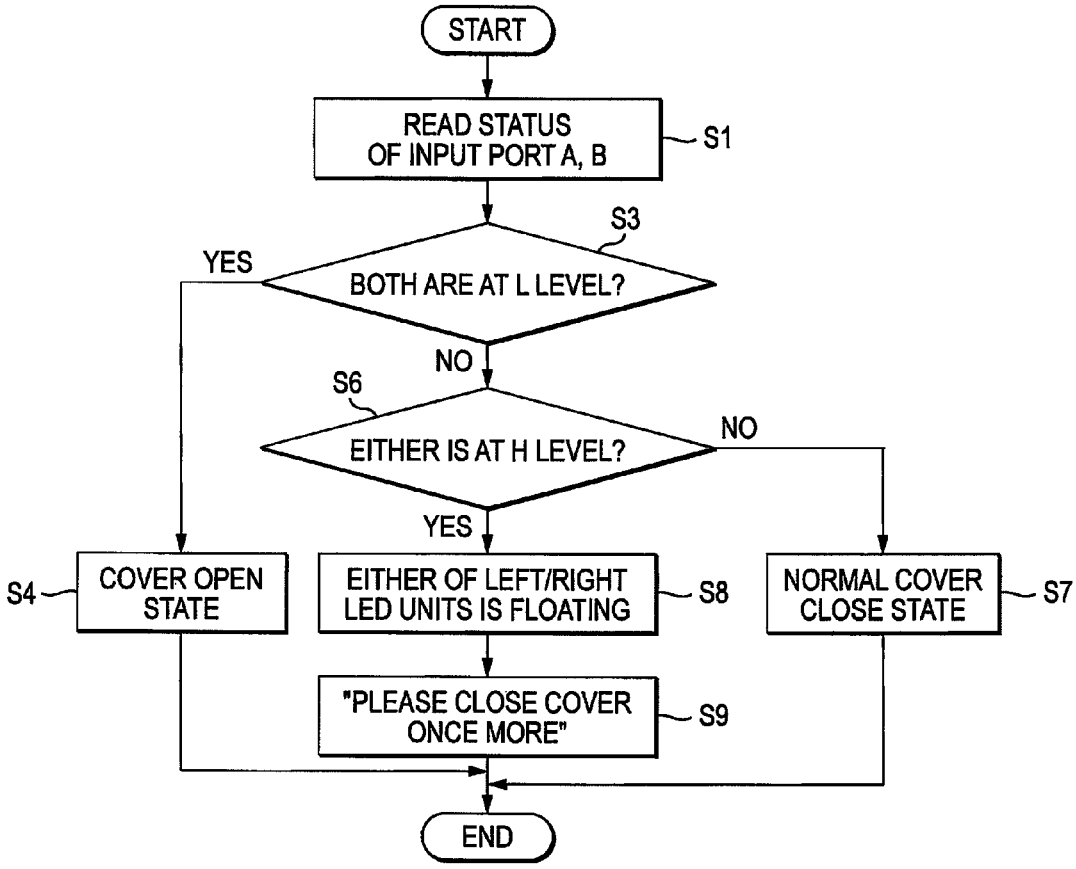
FIG. 5 is a flowchart showing an open/close determining process made by using the power feeding cables.

Next, an open/close determining process, which the ASIC executes based on a program stored in the ROM in the main controller board 72 (an example of an open/close determining unit), of the top cover 5 will be explained. FIG. 5 is a flowchart showing this open/close determining process. Incidentally, this process is executed repeatedly in a predetermined period while a main power supply of the image forming apparatus 1 is kept ON.

As shown in FIG. 5, in this process, first states (either a "H" level or a "L" level) of analog input ports A, B of the ASIC 77 are read in S1 ("S" denotes a step). Then, in S3, it is decided whether or not both of the analog input ports A, B are at "L" level. Then, if both analog input ports A, B are at "L" level (S3: Y), it is decided in S4 that the top cover 5 is in its open state (cover open state). Then, the process is ended once. In this manner, it is decided that the top cover 5 is in its open state (S4), the well-known process is executed. For example, when the recording data is input from the personal computer, or the like, such an effect is noted in another routine (not shown) that the image cannot be formed because the top cover 5 is opened, or the like.

In contrast, if both analog input ports A, B are not at "L" level (S3: N), the process goes to S6. Here, it is decided whether or not only either of the analog input ports A, B is at "H" level. If either of both ports is not at "H" level, i.e., if both analog input ports A, B are at "H" level (S6: N), it is understood that both exposing unit side electrodes 43A, 43B securely contact the housing side electrodes 71A, 71B respectively. Therefore, in such case (S6: N), it is decided in S7 that the top cover 5 is in a normally closed state (normal cover close state). Then, the process is ended once. In this manner, if it is decided that the top cover 5 is in the normally closed state (S7), for example, the image is formed adequately via another routine (not shown) when the recording data are input from the personal computer, or the like.

In contrast, if either of analog input ports A, B is at "H" level (S6: Y), it is understood that only one of either of the exposing unit side electrodes 43A, 43B does not securely contact the housing side electrodes 71A, 71B. Therefore, in such a case (S6: Y), it is decided in S8 that either of the left/right LED units 40 provided to the top cover 5 is floating from the photosensitive drums 31. Then, in S9, for example, the message "Please close cover once more" is displayed on the display panel. Then, the process is ended once. Even when the user perceives that the top cover 5 is perfectly closed, this display can inform the user that the top cover 5 is imperfectly closed and thus one side in the lateral direction of the top cover 5 is floating, and can urge the user to close the top cover 5 once again.

In this manner, in the image forming apparatus 1, when the top cover 5 is closed and the LED units 40 are thus positioned in close vicinity to the photosensitive drums 31 respectively, the exposing unit side electrodes 43A, 43B come into contact with the housing side electrodes 71A, 71B and thus the exposing power can be fed to respective LEDs 41. Therefore, there is no necessity that the long power feeding cables should be kept to pass through the shaft 5B that fix swingably to the top cover 5 of the housing, and the like, and the exposing power can be fed stably at a low cost. In contrast, when the top cover 5 is opened, the exposing unit side electrodes 43A, 43B are moved away from the housing side electrodes 71A, 71B and thus the exposure is stopped. Therefore, such a situation can also be prevented that the light emitted from the LEDs 41 exerts an influence on the human body, and the like.

In the exemplary embodiment, it is decided whether or not the top cover 5 is opened or closed normally and one side of the top cover 5 in the lateral direction is not floating based on whether or not the potentials being input into the analog input ports A, B are within a predetermined range ("H" level) corresponding to the potential, and the potential is given when the housing side electrodes 71A, 71B contact the exposing unit side electrodes 43A, 43B respectively. As a result, even though a switch for detecting the whether the top cover is opened or closed is not provided separately, the open/close of the top cover 5 can be decided satisfactorily. Specifically, when the top cover 5 is tilted with respect to the lateral direction and one side, in the lateral direction, of the top cover 5 is floating, in many cases the user perceived that the top cover 5 is perfectly closed. Even in such a case, the image forming apparatus can notify the user to close the top cover 5 once more.

Figure 6:
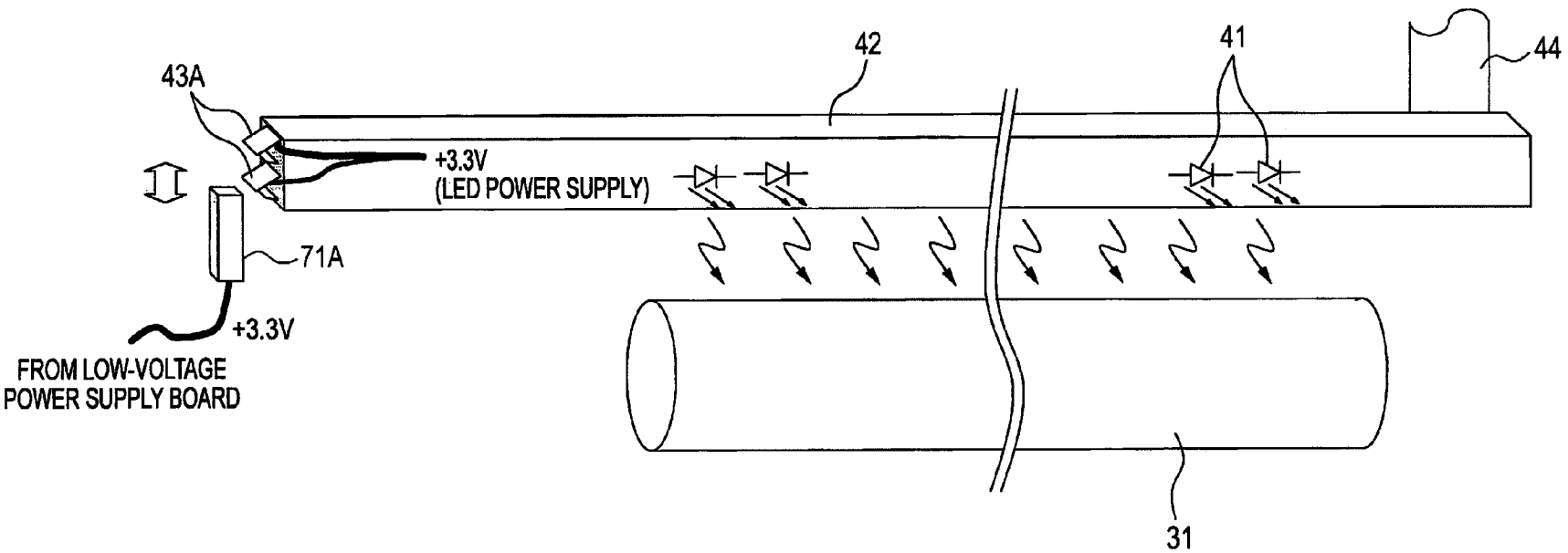
FIG. 6 is a perspective view showing a configuration around the LED head according to one modified exemplary embodiment.
Figure 7:
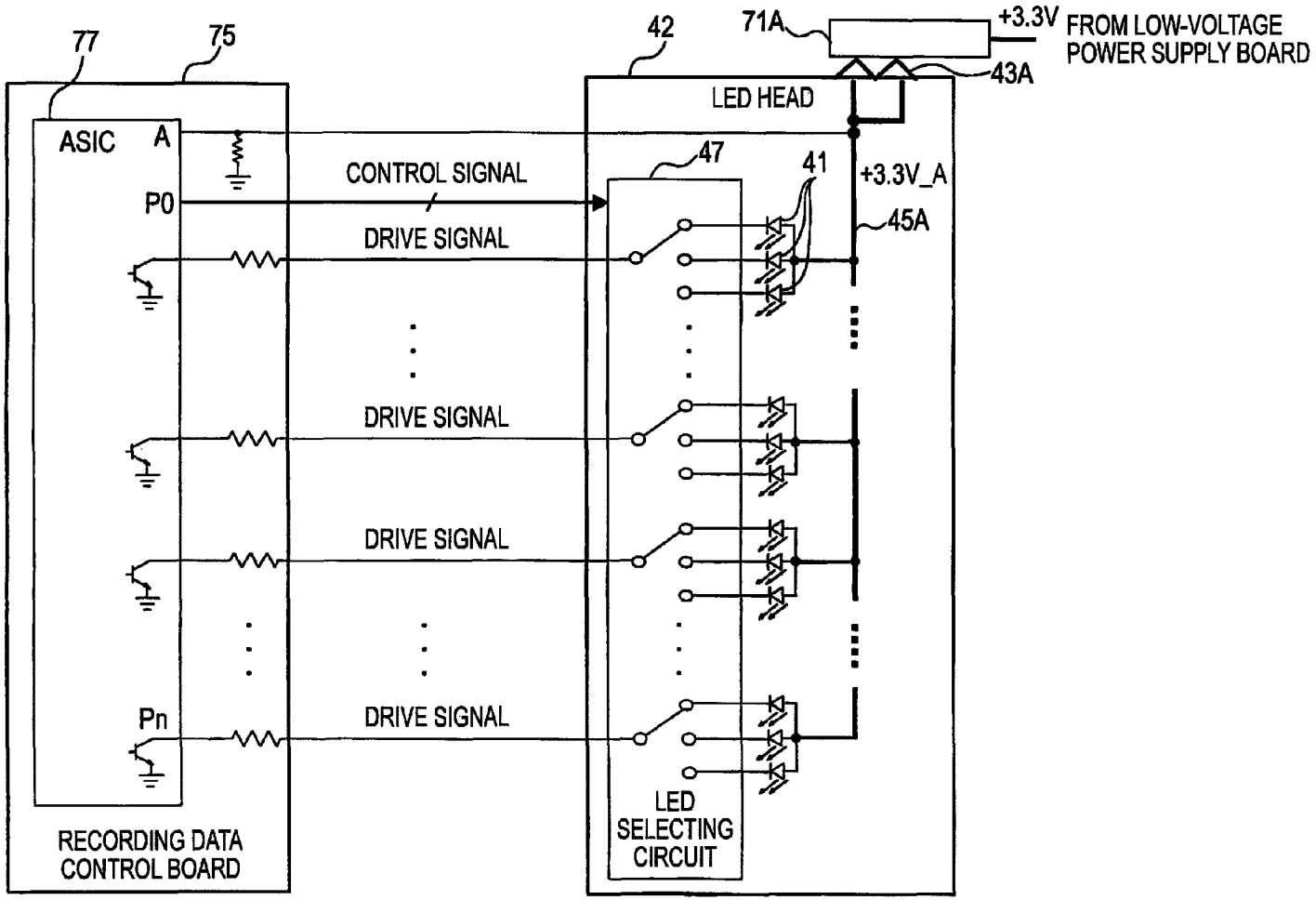
FIG. 7 is an explanatory view schematically showing power feeding cables to the LED head in the one modified exemplary embodiment.

Incidentally, the present invention is not limited to the above-described exemplary embodiments, and can be carried out in various modes without departing from the scope of the present invention, as recited in the claims. For example, in the above-described exemplary embodiment, the exposing unit side electrodes 43A, 43B are provided to both right and left ends of the LED head 42, and correspondingly the housing side electrodes 71A, 71B are provided to the housing 2 side. In this case according to one modified exemplary embodiment, as shown in FIG. 6, any one pair of electrodes (e.g., the exposing unit side electrode 43B and the housing side electrodes 71B) may be omitted. FIG. 7 is an explanatory view schematically showing the power feeding cables to the LEDs 41 corresponding to the one modified exemplary embodiment. As shown in FIG. 7, the exposing unit side electrode 43B and the housing side electrodes 71B are omitted from the power feeding cables and also the analog input port B is omitted, and the drive voltage applied to the exposing unit side electrode 43B are applied to the anodes of all LEDs 41 via the electric wire 45A.

Figure 8:
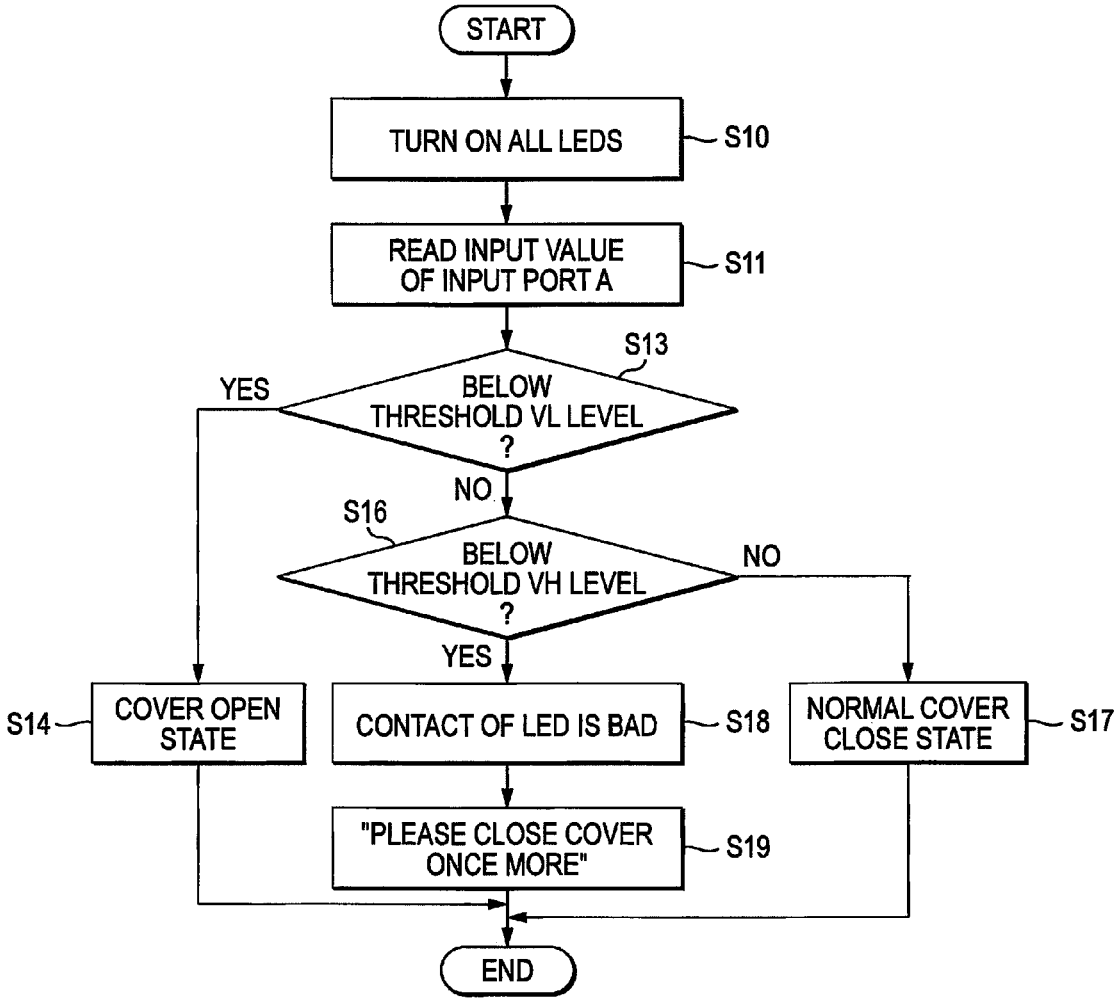
FIG. 8 is a flowchart showing an open/close determining process made by using the power feeding cables in the one modified exemplary embodiment.

Then, in the one modified exemplary embodiment, the ASIC 77 can process the potential being input into the analog input port A as not simply an "H" level or an "L" level but as digital values such as 256 levels, 16 levels, etc., and the main controller board 72 can execute an open/close determining process, as shown in FIG. 8.

More specifically, in the process shown in FIG. 8, in S10, first the control is applied to the ASIC 77 to turn on all LEDs 41. In S11, an input value of the analog input port A of the ASIC 77 is read. Then, in S13, it is decided whether or not the input value is less than a threshold VL level that corresponds to a state that the electrode 43A does not contact the electrode 71A. Then, if the input value is less than the threshold VL level (S13: Y), it is decided in S14 that the cover is in its open state. Then, the process is ended once.

In contrast, if the input value is in excess of the threshold VL level (S13: N), the process goes to S16. Here, it is decided whether or not the input value is less than a threshold VH (VH>VL) level that corresponds to a state that the electrode 43A contacts perfectly the electrode 71A. If the input value is in excess of the threshold VH level (S16: N), it is understood that the electrode 43A contacts perfectly the electrode 71A. Therefore, in such case (S16: N), it is decided in S17 that the cover is in a normally closed state. Then, the process is ended once.

In contrast, if the input value is less than the threshold VH level (S16: Y), it is understood that the electrode 43A does not perfectly contact the electrode 71A. Therefore, in such a case (S16: Y), it is decided in S18 that the contact failure was caused. Then, in S19, for example, the message to the effect that "Please close the cover once more" is displayed on the display panel. Then, the process is ended once. Even though the user perceives that the top cover 5 is perfectly closed, this display can inform the user that the top cover 5 is imperfectly closed, and can urge the user to close the top cover 5 once again. In this manner, because the potential being input into the analog input port A is compared with plural threshold values, it is possible to decide three types of states, i.e., whether or not the top cover 5 is closed, whether or not the top cover 5 is opened, and whether or not the contact between the electrode 71A and the electrode 43A is bad.

Figure 9:
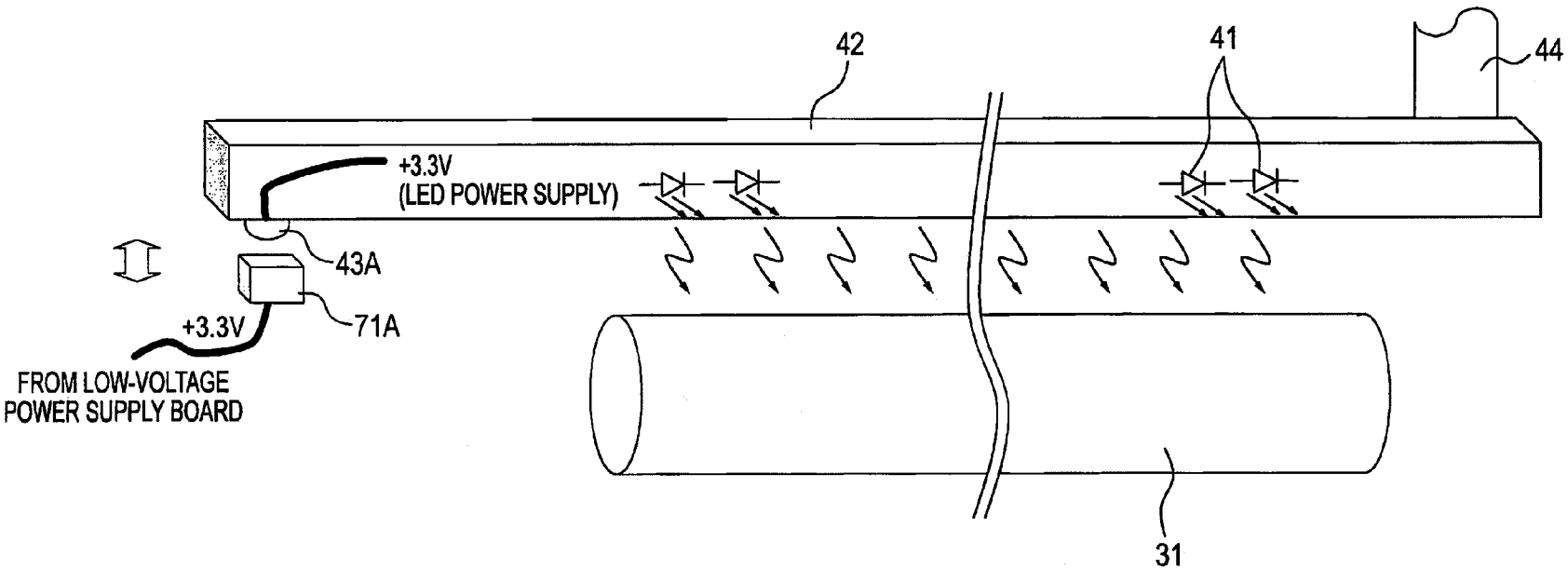
FIG. 9 is a perspective view showing a configuration around the LED head according to another modified exemplary embodiment.
Figure 10:
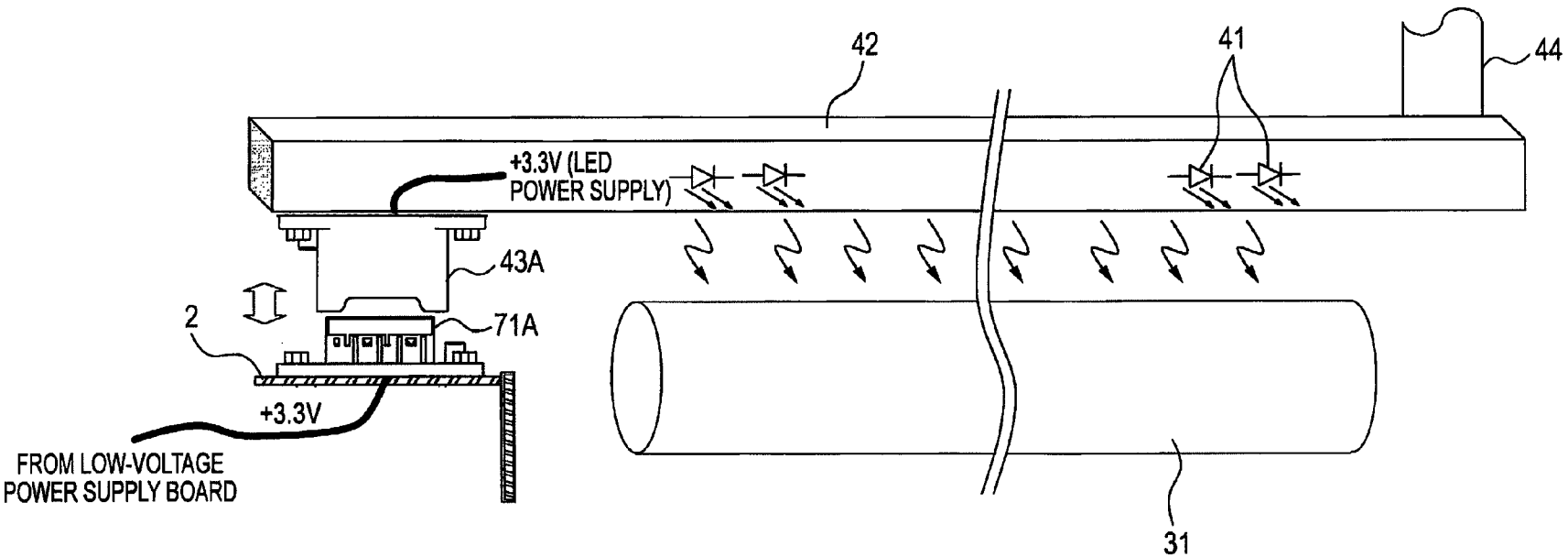
FIG. 10 is a perspective view showing a configuration around the LED head according to still another modified exemplary embodiment.

Modes of the electrodes 43A, 71A can be variously changed. For example, according to another modified exemplary embodiment as shown in FIG. 9, the electrode 43A of the LED unit 40 side may be formed into a hemi-spherical shape that protrudes downward from the lower surface of one end of the LED head 42, and the electrode 71A on the housing 2 side may be formed into a rectangular parallelepiped whose upper surface is flat to accept the electrode 43A from the bottom. Also, according to still another modified exemplary embodiment as shown in FIG. 10, the electrode 43A on the LED unit 40 side may be formed by a drawer connector (female connector) that protrudes downward from the lower surface of one end of the LED head 42, and the electrode 71A on the housing 2 side may be formed by a drawer connector (male connector) that protrudes upward from the housing 2. Further, the exposing unit side electrode may be provided to a position that is distant from the LED head 42 of the LED unit 40. Incidentally, in the above-described exemplary embodiment, the exposing unit side electrodes 43A, 43B as the exposing unit side electrode are provided on the outer periphery of the LED head 42 in which a plurality of LEDs 41 are provided integrally along the scanning direction of the photosensitive drums 31. As a result, the power can be fed directly to the LED head 42, and the loss of power can be lessened much more satisfactorily.

Further, in the above-described exemplary embodiments, if it is decided that the top cover 5 is imperfectly closed, the message "Please close cover once more" is displayed on the display panel in order to urge the user to close the top cover 5 is once again. Alternatively, various means using sound, light, etc. can be adopted for notifying the user to close the top cover 5 is once again.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus, comprising:

a photosensitive member;

a housing configured to house the photosensitive member;

a cover retractably attached to the housing;

an exposing unit, which is included to the cover and configured to selectively move closer to/away from the photosensitive member in response to an opening/closing of the cover, wherein the exposing unit is configured to form a latent image on the photosensitive member by exposing the photosensitive member when the exposing unit is arranged in close vicinity to the photosensitive member by the closing of the cover;

an image forming unit configured to form an image on a recording medium, the image corresponding to the latent image formed on the photosensitive member by the exposure; and a housing side electrode, which is included inside the housing and configured to feed an exposing power to an exposing unit side electrode by contacting the exposing unit side electrode included in the exposing unit when the exposing unit is arranged in close vicinity to the photosensitive member by the closing of the cover;

a potential detecting unit configured to detect a potential of the exposing unit side electrode; and an open/close determining unit configured to determine whether the cover is open or closed based on whether a potential detected by the potential detecting unit is within a predetermined range corresponding to a contact potential when the housing side electrode contacts the exposing unit side electrode, wherein the exposing unit comprises a head, wherein the head comprises a plurality of light emitting elements integrally therewith along a longitudinal direction of the head, and wherein the exposing unit side electrode is disposed at an outer periphery of the head.

2. The image forming apparatus according to claim 1, wherein the open/close determining unit is configured to determine that the cover is closed when the detected potential is in excess of a first threshold value corresponding to a potential when the housing side electrode contacts the exposing unit side electrode, wherein the open/close determining unit is configured to determine that the cover is open when the detected potential is below a second threshold value corresponding to an open potential when the housing side electrode does not contact the exposing unit side electrode, and wherein the open/close determining unit is configured to determine that contact between the housing side electrode and the exposing unit side electrode is faulty when the detected potential is a value between the first threshold value and the second threshold value.

3. The image forming apparatus according to claim 1, wherein the exposing unit side electrode is included at both ends of the head in a scanning direction of the photosensitive member, wherein the potential detecting unit is configured to detect a potential of the exposing unit side electrode at both ends of the head respectively, wherein the open/close determining unit is configured to determine that the cover is opened when both detected potentials at both ends of the head are not within the predetermined range, wherein the open/close determining unit is configured to determine that one end of the cover is floating in the scanning direction of the photosensitive member when one of the detected potentials at both ends of the head is not within the predetermined range but the other detected potential is within the predetermined range, and wherein the open/close determining unit is configured to determine that the cover is closed when both detected potentials at both ends of the head are within the predetermined range.

4. The image forming apparatus according to claim 1, further comprising:

a display unit that displays a message if the open/close determining unit determines that the cover is open.

5. The image forming apparatus according to claim 1, further comprising:

a notification unit that notifies a user to close the cover if the open/close determining unit determines that the cover is open.

6. An electro photography-type image forming apparatus comprising:

a housing having an opening, the housing comprises:

a photosensitive member configured to hold a latent image;

a power source configured to supply power; and a first electrode coupled to the power source; and a cover configured to move between a closed state in which the cover covers the opening and a open state in which the cover opens the opening;

the cover comprising:

an exposing unit configured to form the latent image on the photosensitive member by exposing the photosensitive member when the cover is in the closed state; and a second electrode which is coupled to the exposing unit, wherein the second electrode contacts the first electrode when the cover is in the closed state, and wherein the second electrode is separated from the first electrode when the cover is the in open state;

a potential detecting unit configured to detect a potential of the second electrode; and an open/close determining unit configured to determine whether the cover is open or closed based on whether a potential detected by the potential detecting unit is within a predetermined range corresponding to a contact potential when the first electrode contacts the second electrode, wherein the exposing unit comprises a head, wherein the head comprises a plurality of light emitting elements integrally therewith along a longitudinal direction of the head, wherein the second electrode is disposed at an outer periphery of the head.

7. The image forming apparatus according to claim 6, wherein the open/close determining unit is configured to determine that the cover is in the closed state when the detected potential is within the predetermined range, and wherein the open/close determining unit is configured to determine that the cover is in the open state when the detected potential is out of the predetermined range.

* * * * *